US007222656B2

(12) United States Patent
Nien

(10) Patent No.: US 7,222,656 B2
(45) Date of Patent: May 29, 2007

(54) METHOD OF MAKING A WINDOW COVERING

(75) Inventor: Ming Nien, Taichung (TW)

(73) Assignee: Nine Made Enterprise Co., Ltd., Taichung (TW)

( * ) Notice: Subject to any disclaimer, the term of this patent is extended or adjusted under 35 U.S.C. 154(b) by 332 days.

(21) Appl. No.: 10/921,379

(22) Filed: Aug. 19, 2004

(65) Prior Publication Data

US 2005/0016693 A1 Jan. 27, 2005

Related U.S. Application Data

(63) Continuation-in-part of application No. 10/378,829, filed on Mar. 5, 2003, now Pat. No. 6,854,504, and a continuation-in-part of application No. 10/460,478, filed on Jun. 13, 2003, now Pat. No. 7,195,050.

(51) Int. Cl.
*E06B 9/303* (2006.01)

(52) U.S. Cl. ..... 160/176.1 R; 160/178.3

(58) Field of Classification Search ..... 160/178.3, 160/176.1 R, 177 R, 236
See application file for complete search history.

(56) References Cited

U.S. PATENT DOCUMENTS

| | | | | |
|---|---|---|---|---|
| 1,789,655 | A | | 1/1931 | Iwata |
| 1,851,782 | A | | 3/1932 | Sugiura |
| 2,056,823 | A | | 10/1936 | Brown |
| 2,374,591 | A | | 4/1945 | Dunn |
| 2,608,249 | A | | 8/1952 | Sealy |
| 2,994,370 | A | | 8/1961 | Pinto |
| 3,256,928 | A | | 6/1966 | Hensel |
| 3,386,490 | A | | 6/1968 | Kandel |
| 3,490,515 | A | | 1/1970 | Kandel |
| 4,154,281 | A | * | 5/1979 | Schluep ..... 160/178.3 |
| 4,951,729 | A | | 8/1990 | Chi Yu |
| 4,984,617 | A | | 1/1991 | Corey |
| 5,375,642 | A | | 12/1994 | Gaber |
| 5,775,399 | A | | 7/1998 | Shields, Jr. |
| 5,787,951 | A | * | 8/1998 | Tonomura et al. ..... 160/84.01 |
| 5,829,506 | A | | 11/1998 | Zorbas |
| 6,105,657 | A | | 8/2000 | Zorbas |
| 6,675,859 | B2 | | 1/2004 | Nien |
| 6,834,702 | B2 | * | 12/2004 | Nien ..... 160/178.1 R |
| 7,055,572 | B2 | * | 6/2006 | Nien et al. ..... 160/178.3 |

* cited by examiner

*Primary Examiner*—Blair M. Johnson
(74) *Attorney, Agent, or Firm*—Buchanan Ingersoll & Rooney PC

(57) ABSTRACT

In a method of making a window covering material a plurality of slats preferably made of fabric or plastic film, are provided. Each slat has opposite longitudinal edges and each longitudinal edge has a pocket with at least one transverse slot. There is one rail for each transverse slot in any selected slat. Each rail has a loop extending from the rail which loop is sized to fit within a selected transverse slot in a slat pocket. The fabric slats and the rails are positioned so that there is one loop in each transverse slot. Then a rod is inserted into each pocket of the fabric slat so that for each pocket the rod passes through the loop in each transverse slot of that pocket. If desired, one may attach a light screening flap to one or both longitudinal edges of the slats.

24 Claims, 10 Drawing Sheets

METHOD OF MAKING A WINDOW COVERING

CROSS REFERENCE TO RELATED APPLICATIONS

This application is a continuation-in-part of U.S. patent application Ser. No. 10/378,829, filed Mar. 5, 2003 now U.S. Pat. No. 6,854,504, and published on Jun. 3, 2004, as US 2004/0103994 A) and U.S. patent application Ser. No. 10/460,478, filed Jun. 13, 2003 now U.S. Pat. No. 7,195,050.

BACKGROUND OF THE INVENTION

1. Field of Invention

The invention relates to methods of making window coverings of the type having a plurality of spaced apart slats, as in a venetian blind.

2. Description of the Related Art

Venetian type blinds are well-known and popular window coverings in which a plurality of slats are hung on ladders that extend between the headrail and a bottomrail. The ladders have two parallel rails connected by a series of equally spaced rungs on which the slats rest. The slats usually are metal, wood or plastic, but fabric slats have also been used. The rungs of the ladders in conventional venetian type blinds are not readily seen when the slats are in a horizontal open position. However, when the slats are tilted the rungs may be visible from one side or the other of the blind depending upon how the slats were tilted and whether or not they are obscured by the rails of the ladder.

U.S. Pat. No. 2,374,591 to Dunn discloses a venetian blind having metal slats. The longitudinal edges of the slats are rolled to form a U-shape. Notches are cut in the rolled edge to receive T-shaped clips crimped to tilt cords.

Sugiura in U.S. Pat. No. 1,851,782 discloses a venetian blind in which the slats are tubes of fabric stretched between two parallel rods. Spaced apart strips of material or tapes are secured to the longitudinal edges of the fabric slat. From the figures it appears that the tapes are sewn or glued to the slats. Movement of the tapes tilts the slats.

U.S. Pat. No. 6,105,657 to Zorbas discloses a fabric blind slat and a fabric Venetian blind assembly. The fabric blind slat includes an elongated strip of fabric. The strip of fabric has at least one longitudinally extending pocket on a longitudinal edge into which a relatively rigid support member is insertable. This design of fabric blind slat has drawbacks. Tilting the fabric blind slat moves the fabric body of the fabric blind slat in a manner that causes the upper part of the fabric blind slat to compress the lower part of the fabric blind slat, resulting in a wrinkle. In other words, supporting or stretching means must be provided so that the fabric body of the fabric blind slat can be maintained smooth under any operation status.

Another type of venetian type blind has a fabric sheet or fringe attached to one edge of each slat. This sheet or fringe extends to or below the adjacent slat. An example of this type of blind is disclosed in U.S. Pat. No. 3,388,490 to Kandel. In these blinds, the slats are supported on conventional ladders having parallel rails connected by a series of rungs of which the slats rest.

In United States published application US 2004/0103994 A1, I disclose a venetian type blind having fabric slats that does not utilize conventional ladders with rungs. Instead, I provide braided cords with spaced apart loops or clips that engage rods within the longitudinal pocket along opposite edges of each fabric slat. Consequently, the blind has no ladder rungs. Another advantage of this type of blind is that the blind can be readily assembled in accordance with the method here disclosed. That method can be used for blinds containing slats having pockets along opposite longitudinal edges, as well as blinds having such slats, and a screening flap attached to one or both longitudinal edges.

SUMMARY OF THE INVENTION

In a method of making a window covering material a plurality of slats preferably made of fabric or plastic film, are provided. Each slat has opposite longitudinal edges and each longitudinal edge has a pocket with at least one transverse slot. There is one rail for each transverse slot in any selected slat. Each rail has a loop extending from the rail which loop is sized to fit within a selected transverse slot in a slat pocket. The loop may be woven into the rail or clip affixed to the rail. The fabric slats and the rails are positioned so that ultimately there is one loop in each transverse slot. A rod is inserted into each pocket of the fabric slat so that the rod passes through the loop in each transverse slot of that pocket. If desired, one may attach a light screening flap to one or both longitudinal edges of the slats.

The rails extend between a headrail and a bottomrail. One end of the rails is connected to a tilt mechanism in the headrail or the bottomrail. The rails may be attached to the headrail and bottomrail before or after being connected to the slats.

Other objects and advantages of the present method will become apparent from a description of the present preferred embodiments thereof as illustrated in the drawings.

DESCRIPTION OF THE PREFERRED EMBODIMENTS

Figure 1:
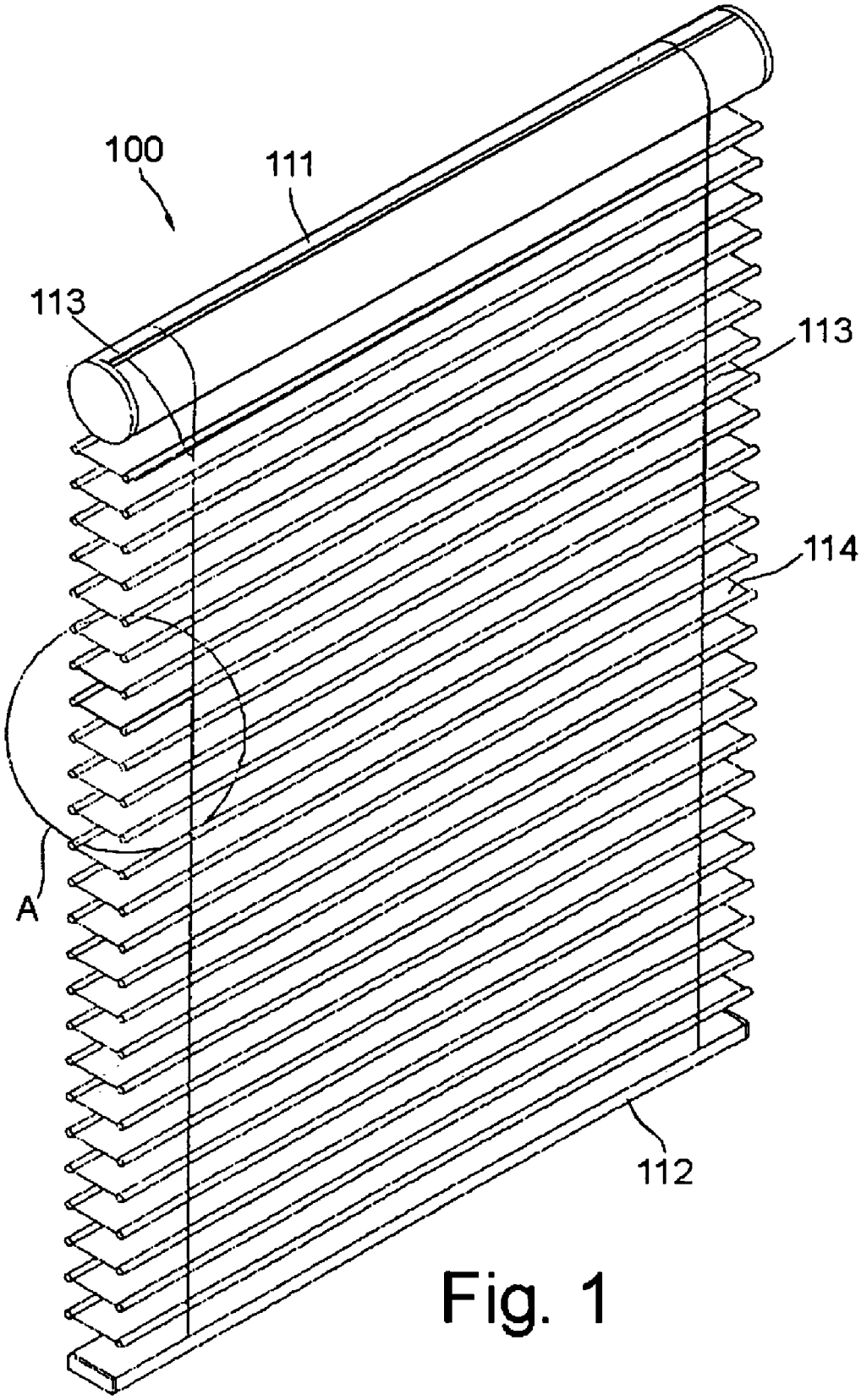
FIG. 1 is a perspective view of a blind that can be made using a first preferred embodiment of the method for making a window covering.

Referring to FIGS. 1 through 5, a first venetian type blind assembly 100 having window covering material made in accordance with the present invention has a headrail 111 and a bottomrail 112 between which the window covering material is attached. The window covering material is comprised of a plurality of equally spaced fabric blind slats 114 which are held by rails 113. Each fabric blind slat 114 includes an elongated strip of fabric 141 and two rod members 142. The strip of fabric 141 is a piece of fabric capable of diffusing or reflecting light. The fabric may be opaque material or material having a weave through which light may pass. Each slat has two pockets 143 longitudinally extended along two opposite long sides thereof. The pockets 143 can be formed by folding the edges of the strip of fabric 141 and securing the fold by stitching, adhesive bonding or welding. Each pocket 143 has transversely extended slots 144. The rod members 142 are rigid or semirigid metal or plastic members, having an outer diameter smaller than the inner diameter of the pockets 143. The length of the rod members 142 is substantially equal to the longitudinal depth of the pockets 143. When inserted into the pockets 143, the rod members 142 can be slightly rotated in the pockets 143.

Figure 2:
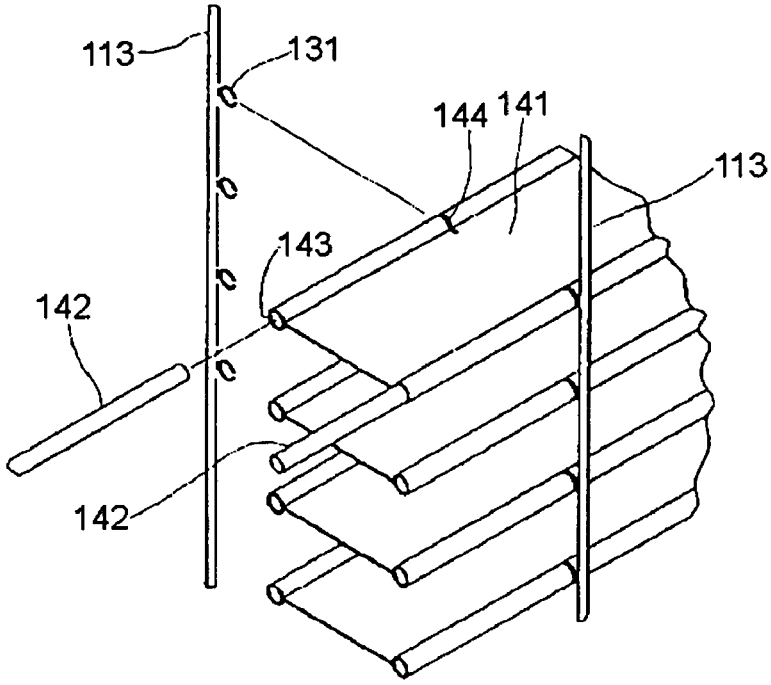
FIG. 2 is an exploded view of a portion of the blind shown in FIG. 1 from which the first preferred embodiment of the method can be best understood.
Figure 3:
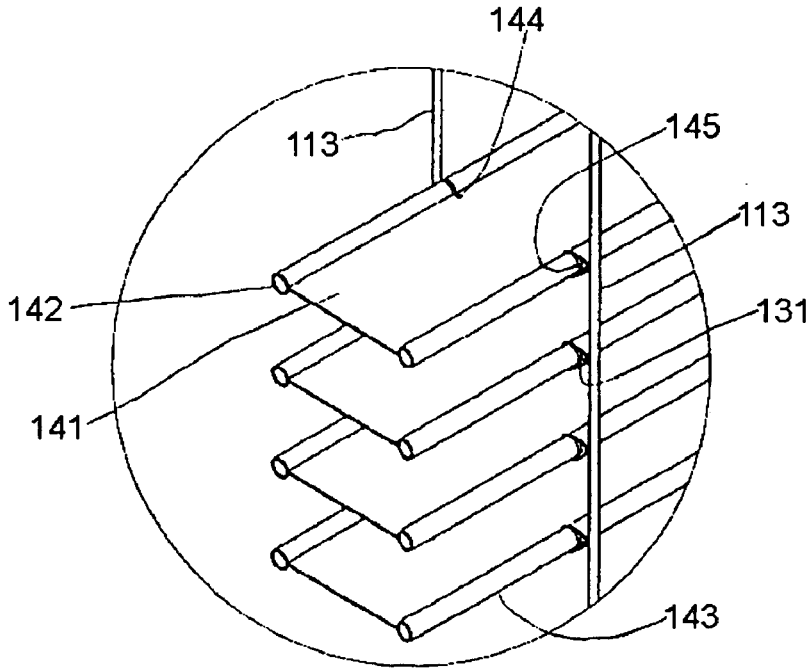
FIG. 3 is an enlarged view of the portion of the blind that is within circle A in FIG. 1.

As can be seen most clearly in FIGS. 2 and 3, each rail 113 has a plurality of spaced apart loops 131 which fit into a transverse slot 144 in the longitudinal pocket 143 of a fabric slat, the loop may be rigid plastic or metal structure attached to the rail. However, in a preferred rail 223, shown in FIG. 7, the loop 231 is a thread or threads, the loops 231 being formed on the rail 223 as the rail is braided or otherwise manufactured.

Figure 4:
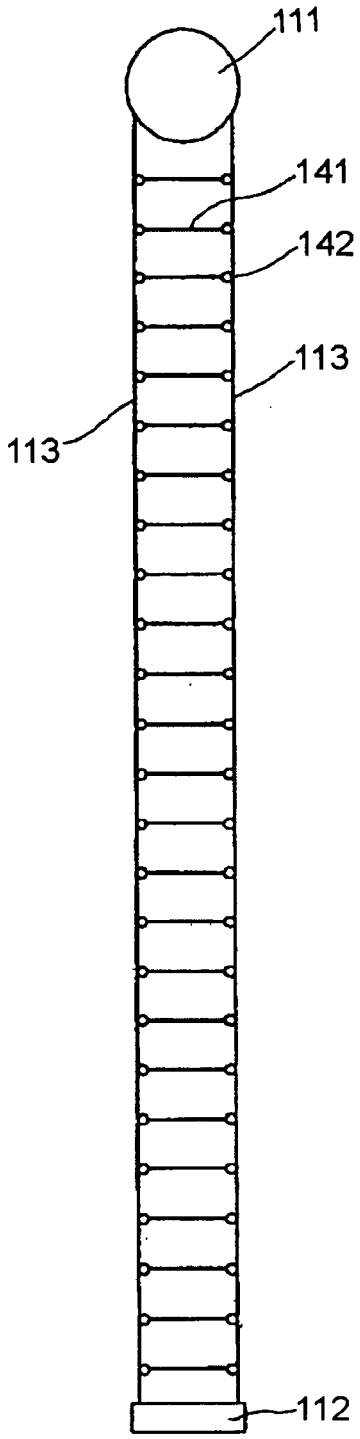
FIG. 4 is a side view of the blind shown in FIG. 1 with the blind in a fully lowered, open position.
Figure 5:
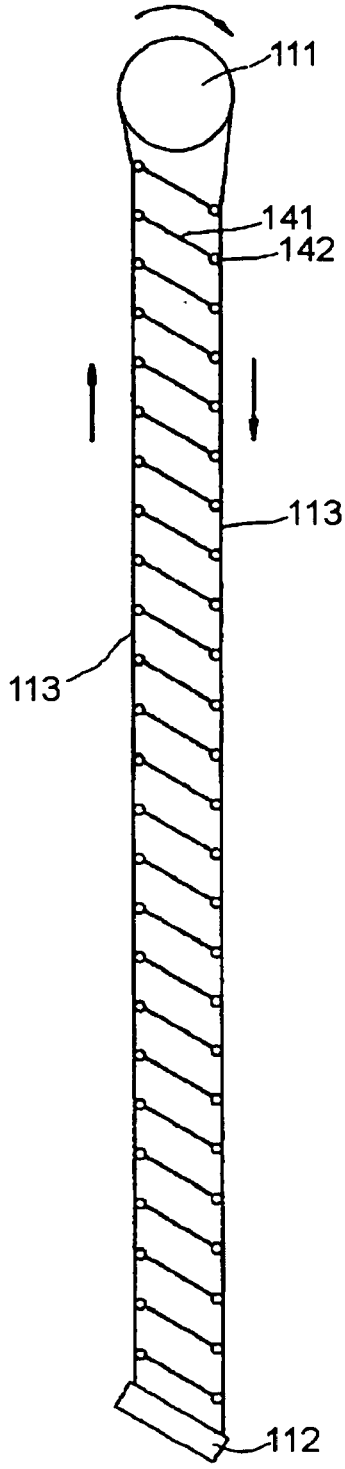
FIG. 5 is a side view similar to FIG. 4 with the blind in a fully lowered, partially closed position.

To make the window covering shown in FIGS. 1 though 5 one obtains or makes a plurality of fabric slats 141 having longitudinal pockets 143. In this blind assembly two transverse cuts or slots 144 are provided in each of the longitudinal pockets 143 such that for each slot in one pocket there is an aligned slot in the opposite pocket as shown in FIGS. 2 and 3. Next one positions the rails 113 so that there is one loop 131 from one of the rails 113 in each slot 144. When the loops are so positioned a rod is inserted into each pocket 143 so as to pass through the loops that are in the slots of that pocket. If a pocket has more than one slot one could place a loop in the first slot, advance the rod through the pocket and loop, insert a second loop in the second slot, advance the rod through that loop and continue the process until the rod is fully within the pocket. If desired one could first attach a rail or rails to one longitudinal edge of several slats and then connect the rails to the second longitudinal edge of the same slats. Alternatively, one could attach all the rails to one slat, then attach all the rails to the next slat and continue slat by slat until the window covering is complete. Other variations in the order of attaching rails to slats could be followed without departing from the present method. As another example, one could attach rails to the top slat and the bottom slat and then attach the intermediate slats. At some point one end of each rail is attached to the bottomrail 112 and the opposite end is attached to the headrail 111. Typically, one end of each rail would be connected to tilt mechanism within the headrail or the bottomrail as shown in FIGS. 4 and 5. The order of attachment is not critical. Moreover, one could attach the rails to the bottomrail and headrail before or after attaching the fabric slats to those rails.

After the window covering material has been assembled the rod members 142 support the fabric blind slats 114 in a longitudinal direction, prohibiting the strip of fabric 141 of each fabric blind slat 114 from curving downwards and the braided rails 113 support the fabric slats 114 in transverse direction, keeping the fabric blind slats 114 smooth.

As in a conventional venetian blind movement of the rails will cause the fabric slats to move from an open position shown in FIG. 4 to a partially closed position shown in FIG. 5, or fully closed position (not shown). Because the rod members 142 can be rotated relative to the loops 131 of the rails 113, rotating the headrail 111 to tilt the fabric blind slats 114 causes the loops 131 to be turned relative to the rod members 142, thereby preventing uneven tension between the rails 113 and the fabric blind slats 114.

Figure 6:
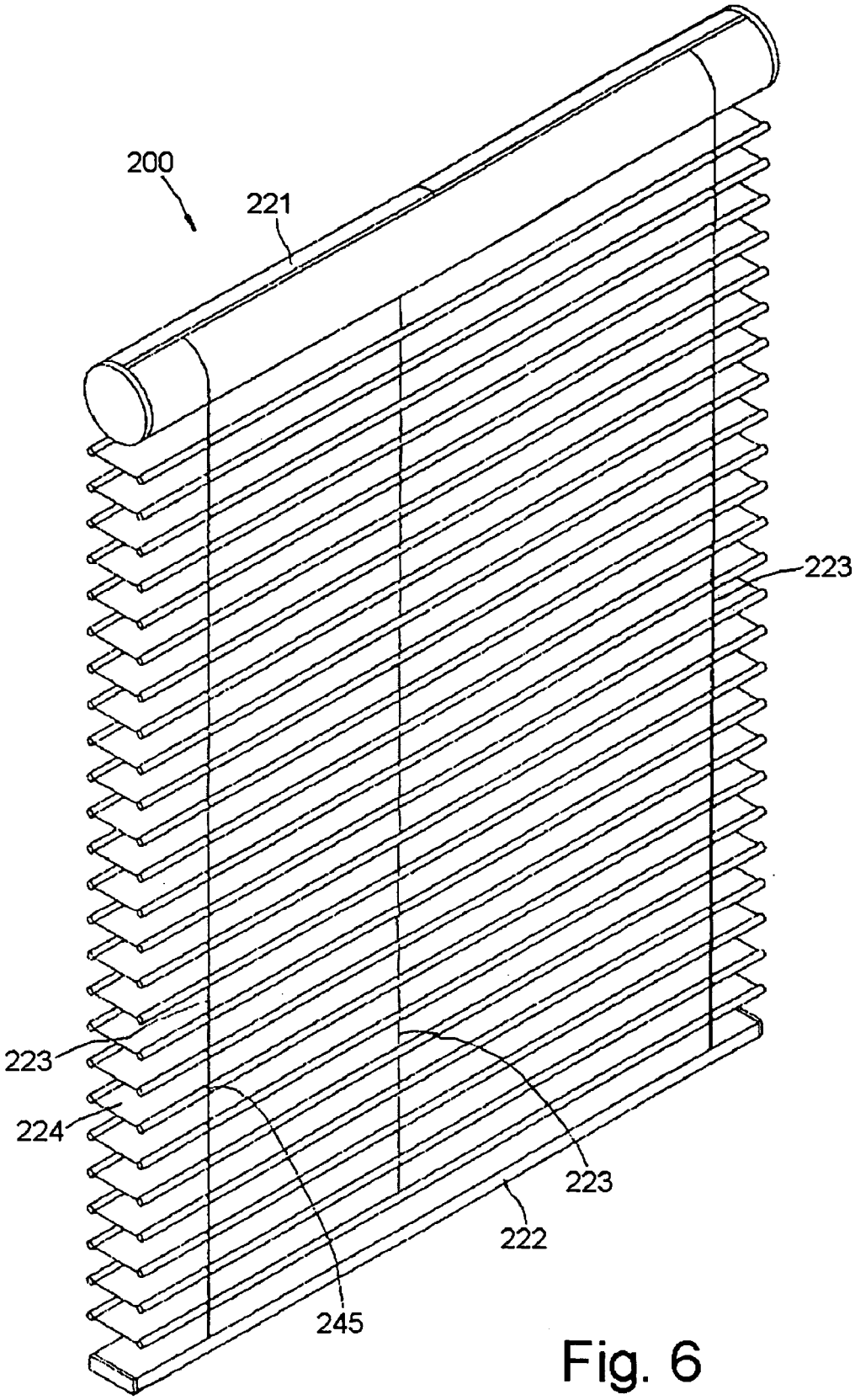
FIG. 6 is a perspective view of a second blind that can be made in accordance with the present method.
Figure 7:
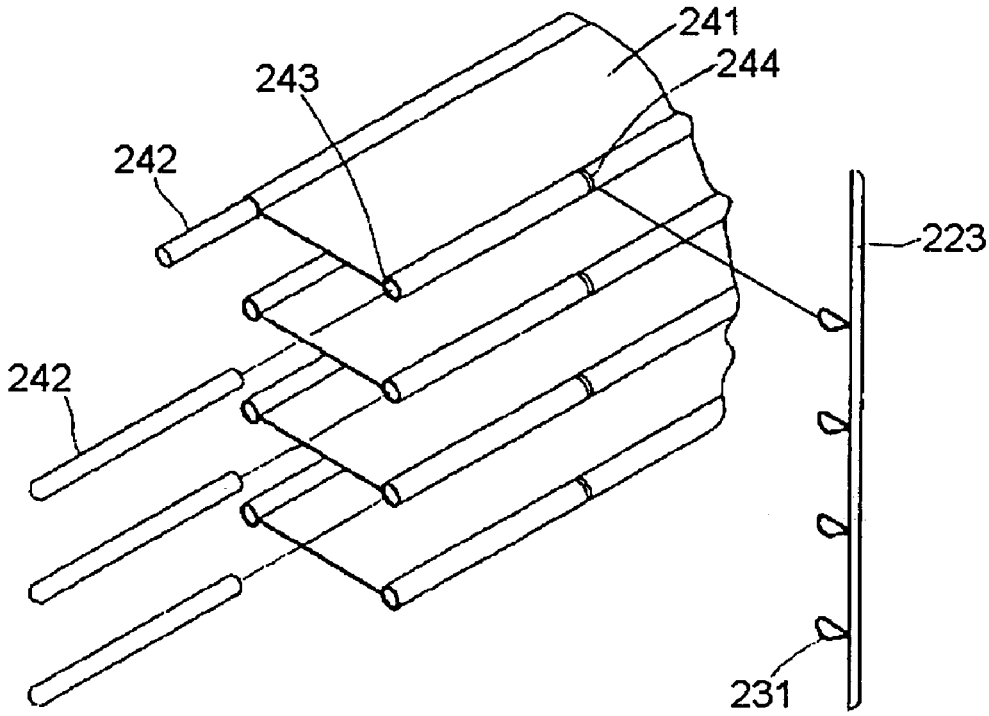
FIG. 7 is an enlarged exploded view similar to FIG. 2 of a portion of the blind shown in FIG. 6.
Figure 8:
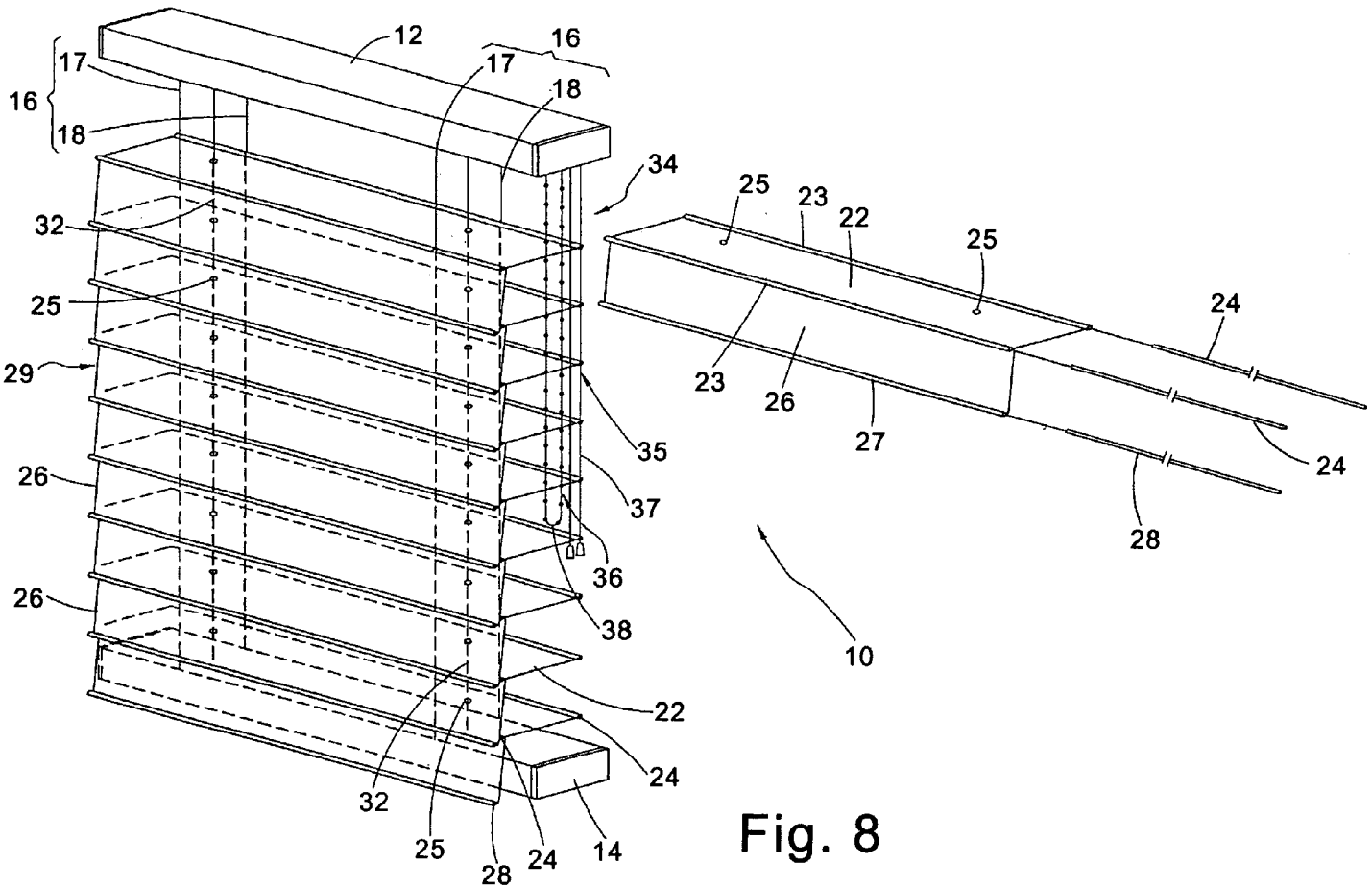
FIG. 8 is an exploded view of a third window covering that can be made with the present method.

A second window blind that can be made with the present method is shown in FIGS. 6 and 7. That blind 200 has a headrail 221, bottomrail 222 and a plurality of fabric blind slats 224 carried on three rails 223. Each of the rails 223 has a plurality of equally vertically spaced loops 231 for fastening the rails 223 to the fabric blind slats 224.

Each fabric blind slat 224 is composed of an elongated strip of fabric 241 and two rods 242. The strip of fabric 241 has two pockets 243 longitudinally extended along two opposite long sides thereof. One of the two pocket 243 of each fabric blind slat 24 is provided with two transversely extended slots 244, and the other pocket 243 of each fabric blind slat 24 is provided with one transversely extended slot 244. The rod members 242 are inserted into the pockets 243. Before insertion of the rods 242 into the pockets 243, the loops 231 of the rails 223 are respectively inserted into the slots 244 of the pockets 243 of the fabric blind slats 224, and then the rods 242 are respectively inserted into the pockets 243 and the loops 231, enabling the rods 242 to be respectively secured with the pockets 243. The rails 233 are attached to a headrail and bottomrail. Again, the order of attachment is not critical.

Referring to FIGS. 8 through 11 a third window covering 10 which can be made in accordance with the present method is comprised of a headrail 12, a bottomrail 14, sets 16 of rails 17, 18, a plurality of flexible slats 22, a plurality of flexible light screening flaps 26, two lift cords 32, and a control unit 34. The headrail 12 is a hollow frame bar transversely (horizontally) affixed to the top side of a window (not shown). The bottomrail 14 is a hollow frame bar arranged in parallel to and suspended from the headrail 12.

Each set 16 is comprised of a front rail 17 and a rear rail 18 similar to rail 113 shown in FIG. 2 or rail 223 shown in FIG. 7. The rails 17 and 18 each have a top end respectively inserted into the headrail 12 and a bottom end fixedly connected to the bottomrail 14. According to this embodiment, the rails 17 and 18 are symmetrically provided at two sides. Depending upon the transverse width of the window, the combination window covering can be equipped with more sets of rails. The rails could be offset from one another as in the window covering of FIG. 6.

The slats 22 are narrow, elongated, rectangular members made of fabric of low penetrability to light, and arranged in parallel between the headrail 12 and the bottomrail 14 within the space defined between the front rails 17 and the rear rails 18. Each slat 22 has two sleeves or pockets 23 respectively extended along the respective two opposite long sides. Two plastic ribs 24 are respectively inserted into the sleeves 23 and respectively connected to the front rails 17 and the rear rails 18. The slats have two holes 25 for the passing of the lift cords 32. The plastic ribs 24 support the flexible slat 22 to maintain its shape. As in the previous embodiment, the sleeves or pockets 23 have slots so that the respective loops of the rails 17 and 18 can encircle the plastic ribs 24.

Figure 9:
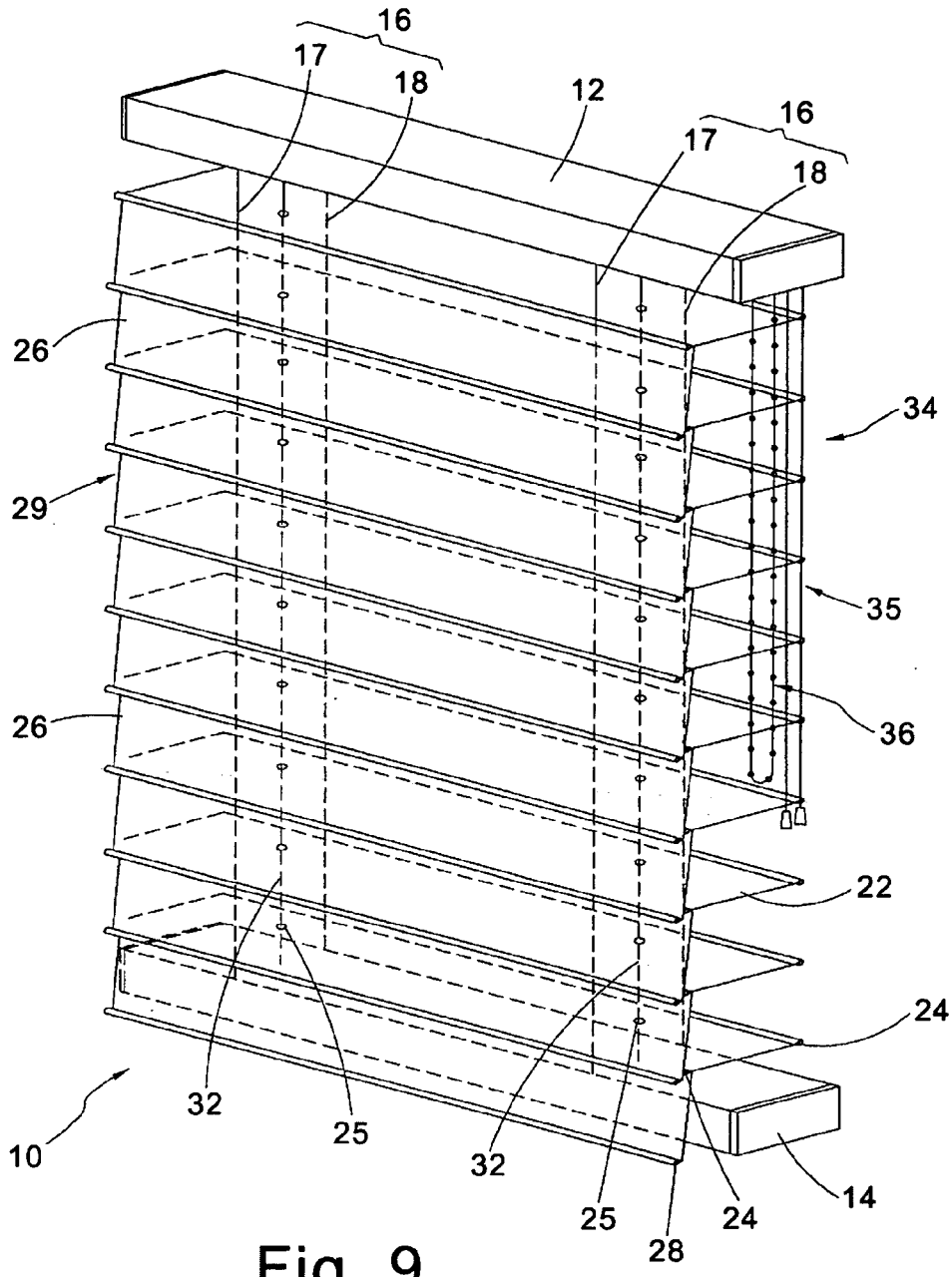
FIG. 9 is a perspective assembly view of the third window covering shown in FIG. 8.
Figure 10:
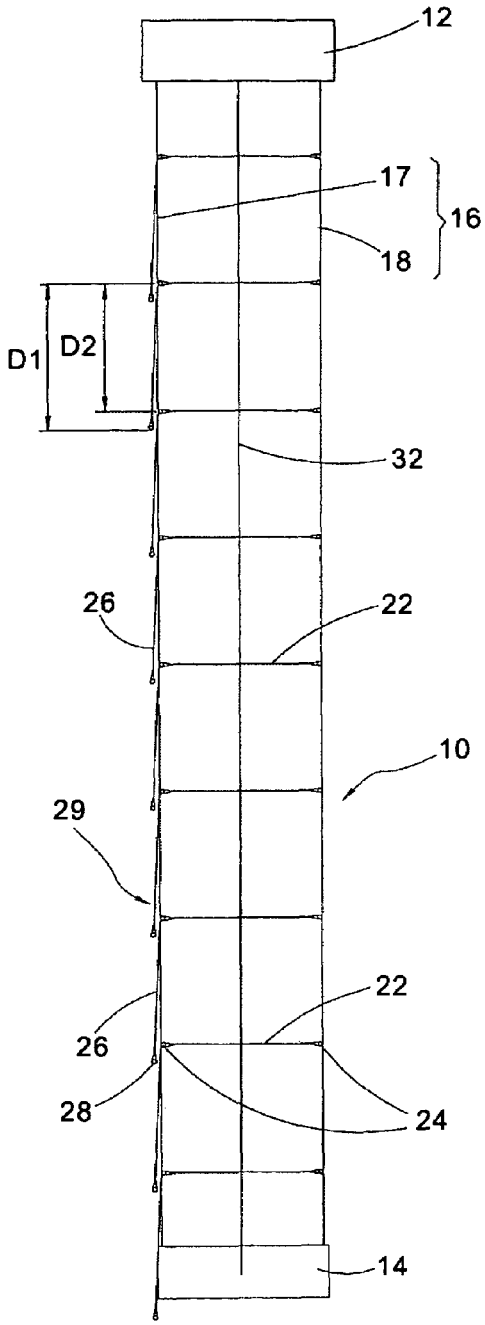
FIG. 10 is a side view of the window covering shown in FIGS. 8 and 9 in a fully lowered open position.

The flexible light screening flaps 26 of the slat units are rectangular pieces of thin layer of meshed fabric or film equal to the length and number of the flexible slats 22, and preferably have a permeability to light relatively higher than the light permeability of the slats 22. Each flap has one long side stitched to one long side of one flexible slat 22 and the other long side provided with a sleeve or pocket 27 and a rib 28 in the sleeve 27. As illustrated in FIG. 10, the flexible light screening flaps 26 are respectively vertically suspended from the slats 22. The width $D_1$ of the flexible light screening flaps 26 is slightly greater than the distance or pitch $D_2$ between two adjacent slats 22 (which corresponds to the distance between each two vertically spaced adjacent loops of each of the front and rear rails.) Therefore, when the flexible light screening flaps 26 are suspended from the slats 22, the bottom side edges of each flexible light screening flap 26 is lower than the elevation of the front long side of the respective slat 22 below, i.e., the bottom side edge of each flexible light screening flap 26 covers the front edge of the next slat 22. Therefore, the flexible light screening flaps 26 form a light screening face 29 on one side of the combination window covering 10, as shown in FIG. 9. In the same way, flexible light screening flaps may be respectively fastened to the other long side of each of the flexible slats. Then there would be a light screening face on both sides of the combination window covering.

The control unit 34 comprises a lift cord mechanism operated by cords 35 and a tilt control mechanism operated by cord loop 36. The lift control mechanism is to be operated by the user to lift or lower the bottomrail 14, so as to further stack or extend the slats 22. The tilt mechanism is adapted to control relative movement of the front ladder rails 17 and the rear ladder rails 18 vertically in opposite directions, so as to tilt the slats 22. The control unit 34 is of the known art and can comprise two rod members (not shown) fastened rotatably with the inside of the headrail 12, a pair of reels (not shown) respectively mounted on one rod member, a barrel for each pair of rails mounted on the second rod member, a lift-control operation cord set 35 and a tilt-control operation chain 36 respectively coupled to the rod members for operation by the user to rotate the rod members respectively. The top ends of the lift cords 32 are respectively fastened to the two reels on the second rod member. The front rails 17 and rear rails 18 of the sets 16 are respectively coupled to opposite sides of the barrels on the first rod member. Because the control unit is of the known art and not within the scope of the claims of the present invention, no further detailed description in this regard is necessary.

Figure 11:
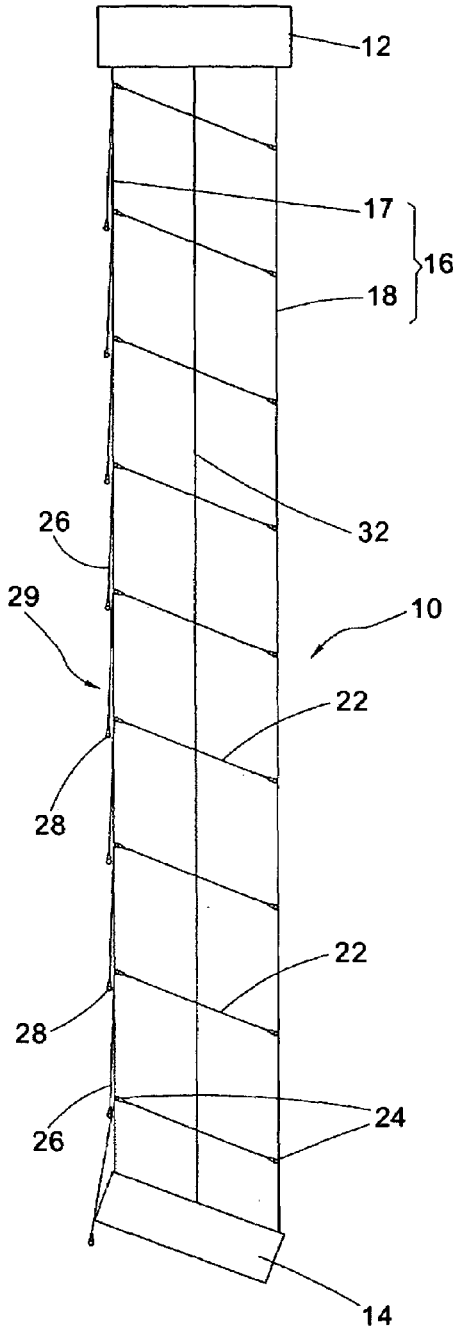
FIG. 11 is a side view similar to FIG. 10 showing the blind in a partially closed position.

When the aforesaid combination window covering 10 is assembled, the slats 22 block the light or the sight between the outside of the room and the inside of the room. By means of operating the tilt control cords 36 of the control unit 34 to move the front rails 17 and the rear rails 18 in opposite directions, the slats 22 are tilted to regulate the light, as shown in FIGS. 10 and 11.

The flexible light screening flaps 26 are vertically suspended from the slats 22 at the front side. The ribs 28 of the flexible light screening flaps 26 support the front long side of each flexible flap 26 to stabilize and smoothen the suspension of those flaps forming the aforesaid light screening face 29. The light screening face 29 screens and softens the light, producing a soft and pleasant atmosphere in the room.

Figure 12:
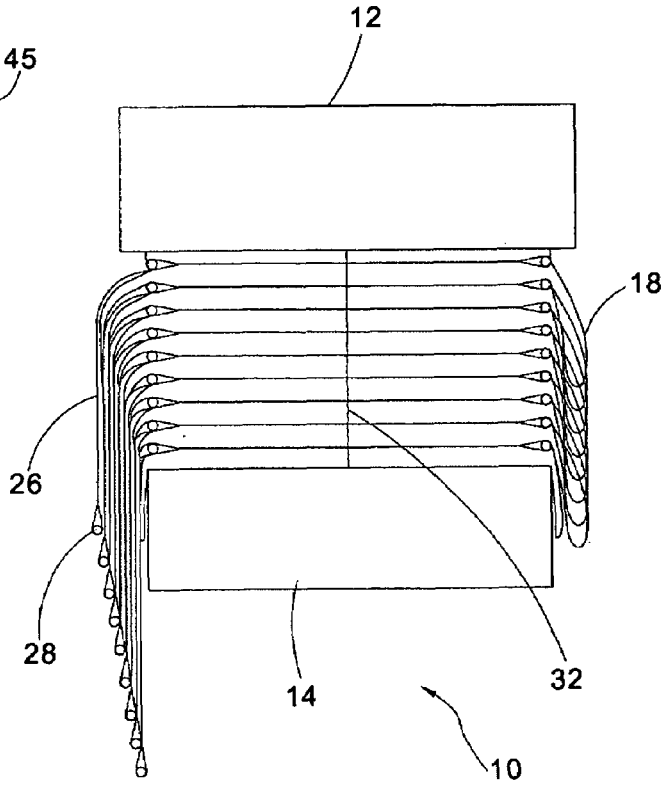
FIG. 12 is a side view of the blind shown in FIGS. 8 through 11 in a fully raised position.

When operating the lift control cords 35 of the control unit 34 to roll up the lift cords 32, the bottomrail 14 is lifted, and the slats 22 are stacked onto one another from the bottom side toward the top side to the fully raised position shown in FIG. 12. When the slats 22 are stacked together, the flexible light screening flaps 26 are overlapped on one another in order as shown in FIG. 12.

In comparison with other conventional products having similar functions, the window covering material 10 shown in FIGS. 8 through 12 has a simple structure and is easy to manufacture using the method here disclosed. Further, it is practical to have the slats and the light screening flaps made of the same fabric material, i.e., each light screening flap and the corresponding slat can be formed of one single piece of fabric sewn to form a flexible slat and an integrated light screening flap light. The portion of the single piece of fabric forming the slat may be coated with a layer of film or color paint.

As indicated above, the slats, as well as the light screening flaps of the combination window covering shown in FIGS. 8 through 12, are preferably made of fabric instead of conventional plastic or wooden material. Therefore, the combination window covering softens the light, producing a pleasant atmosphere in the house.

Figure 14:
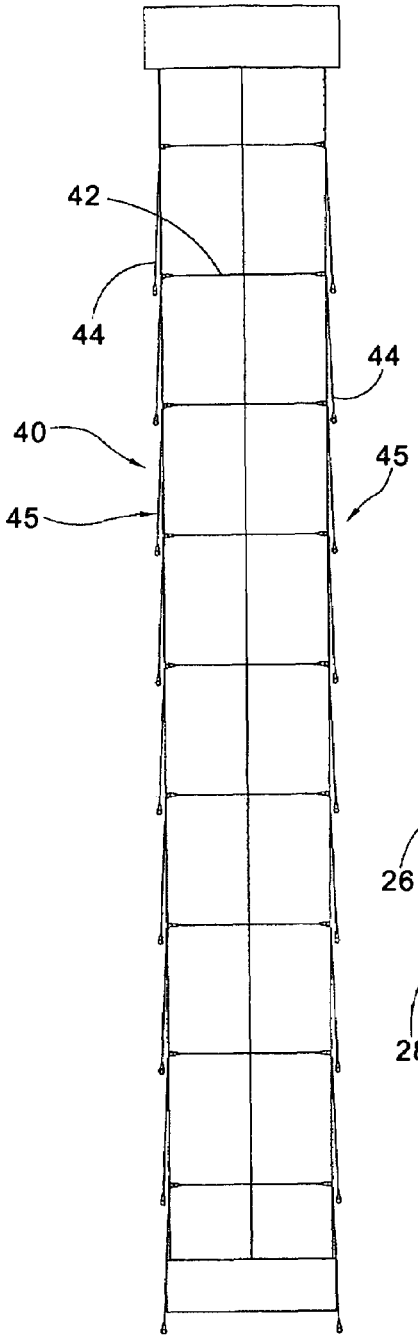
FIG. 14 is a side view of the blind shown in FIG. 13 in a fully lowered, open position. 4.
Figure 13:
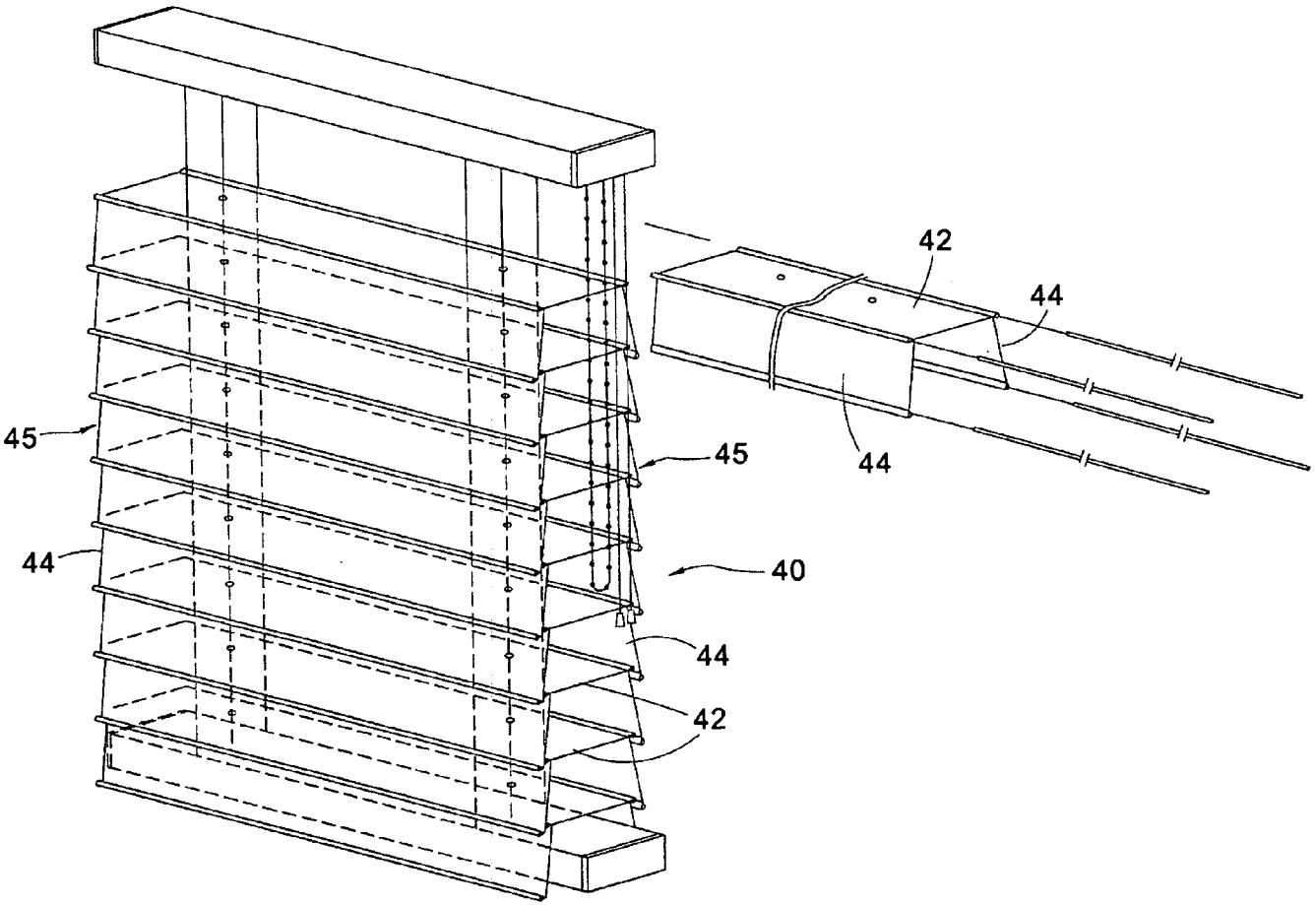
FIG. 13 is an exploded assembly view of a fourth window blind that can be made using the present method.

FIGS. 13 and 14 show a fourth blind 40 that can be constructed according to the method here disclosed. This embodiment is similar to the aforesaid third window blind 10 shown in FIGS. 8 through 12 with the exception of the arrangement of flexible light screening flaps. According to this embodiment, flexible light screening flaps 44 of the slat units are respectively provided at the front and rear long sides of the flexible slats 42 of the slat units, forming a respective light screening face 45 at the front and rear sides of the flexible slats 42.

In the embodiments shown in FIGS. 8 through 14, the light screening flaps typically will be sewn into the fabric slats before the slats are connected to the rails. However, one could: connect the light screening flaps to the fabric slats after the slats have been connected to the rails. In that event, the flaps may be attached to the slats with Velcro hook and loop fasteners or adhesive tape rather than being sewn into the fabric slats.

Although all of the window blinds shown in the drawings have fabric slats, the present method could be used with plastic, plastic film, metal, metal foil or wood slats that have pockets with slots along their longitudinal edges. Similarly, the light screening flaps could be a film rather than a fabric. The rails could be plastic, metal or wood rather than braided cord, particularly if plastic, metal or wood slats are used. Such a window covering would be more like a shutter than a venetian blind.

Although I have shown and described certain preferred methods of making window coverings it is to be distinctly understood that the invention is not limited thereto, but may be variously embodied within the scope of the following claims.

I claim:

1. A method of making a window covering material comprising:

providing a fabric slat having opposite longitudinal edges and each longitudinal edge having a pocket with at least one transverse slot;

providing a plurality of cord rails such that there is one rail for each transverse slot, each rail having a loop extending from the rail, each loop sized to fit within a selected one of the at least one transverse slot in the fabric slat;

positioning the fabric slat and the rails so that there is one loop in each transverse slot; and inserting a rod into each pocket of the fabric slat in manner so that for each pocket the rod passes through the loop in each transverse slot of that pocket.

2. The method of claim 1 also comprising:

providing a plurality of additional fabric slats, each slat having opposite longitudinal edges and each longitudinal edge having a pocket with at least one transverse slot;

wherein each of the plurality of rails has an additional loop for each additional fabric slat;

positioning each additional fabric slat and the rails so that there is one additional loop from each rail within each transverse slot of each additional fabric slat; and inserting a rod into each pocket of each additional fabric slat in a manner so that for each pocket the rod passes through the loop in each transverse slot of the pocket.

3. The method of claim 2 wherein the loops on each rail are equally spaced.

4. The method of claim 1 also comprising attaching one end of each rail to a bottom rail and connecting an opposite end to a headrail.

5. The method of claim 4 also comprising connecting each rail to a tilt mechanism within the headrail or the bottomrail.

6. The method of claim 1 also comprising attaching a screening flap to the first longitudinal edge of the fabric slat.

7. The method of claim 6 wherein the screening flap is attached to the fabric slat prior to positioning the fabric slat and the rails so that there is one loop in each transverse slot.

8. The method of claim 6 also comprising attaching a second screening flap to the second longitudinal edge of the fabric slat.

9. The method of claim 6 also comprising:

providing at least one additional fabric slat, each additional fabric slat having first and second opposite longitudinal edges and each longitudinal edge having a pocket with at least one transverse slot;

attaching an additional screening flap to the first longitudinal edge of each additional slat;

wherein each of the plurality of rails has an additional loop for each additional fabric slat;

positioning each additional fabric slat and the rails so that there is one additional loop from each rail within each transverse slot of each additional fabric slat; and inserting a rod into each pocket of each additional fabric slat in a manner so that for each pocket the rod passes through the loop in each transverse slot of the pocket.

10. The method of claim 9 also comprising attaching a second screening flap to the second longitudinal edge of each additional fabric slat.

11. The method of claim 9 wherein adjacent fabric slats are equally spaced a selected distance from one another and the screening flaps each have a width approximately equal to the selected distance.

12. The method of claim 6 wherein the fabric slat is made of an opaque or semitransparent fabric and the screening flap is made of a translucent or transparent material.

13. The method of claim 6 wherein the screening flap is fabric.

14. The method of claim 6 wherein the screening flap is a sheer fabric.

15. The method of claim 6 wherein the screening flap has a bottom edge and a pocket on the bottom edge and further comprising inserting a rod into the pocket of each screening flap.

16. The method of claim 6 wherein the screening flap has a bottom edge and a pocket on the bottom edge and further comprising inserting a rod into the pocket of the screening flap.

17. A method of making a window covering material comprising:

providing a slat having opposite longitudinal edges and each longitudinal edge having a pocket with at least one transverse slot;

providing a plurality of cord rails such that there is one rail for each transverse slot, each rail having a loop extending from the rail, each loop sized to fit within a selected one of the at least one transverse slot in the slat;

positioning the slat and the rails so that there is one loop in each transverse slot; and inserting a rod into each pocket of the slat in manner so that for each pocket the rod passes through the loop in each transverse slot of that pocket.

18. The method of claim 17 also comprising:

providing a plurality of additional slats, each slat having opposite longitudinal edges and each longitudinal edge having a pocket with at least one transverse slot;

wherein each of the plurality of rails has an additional loop for each additional slat;

positioning each additional slat and the rails so that there is one additional loop from each rail within each transverse slot of each additional slat; and inserting a rod into each pocket of each additional slat in a manner so that for each pocket the rod passes through the loop in each transverse slot of the pocket.

19. The method of claim 18 wherein the loops on each rail are equally spaced.

20. The method of claim 17 also comprising attaching one end of each rail to a bottom rail and connecting an opposite end to a headrail.

21. The method of claim 20 also comprising connecting each rail to a tilt mechanism within the headrail or the bottomrail.

22. The method of claim 17 also comprising attaching a screening flap to the first longitudinal edge of the fabric slat.

23. The method of claim 22 wherein the screening flap is attached to the fabric slat prior to positioning the fabric slat and the rails so that there is one loop in each transverse slot.

24. The method of claim 22 also comprising attaching a second screening flap to the second longitudinal edge of the fabric slat.

* * * * *

UNITED STATES PATENT AND TRADEMARK OFFICE

CERTIFICATE OF CORRECTION

PATENT NO. : 7,222,656 B2
APPLICATION NO. : 10/921379
DATED : May 29, 2007
INVENTOR(S) : Ming Nien It is certified that error appears in the above-identified patent and that said Letters Patent is hereby corrected as shown below:

On the title page:
At (73) Assignee, change “Nine” to --Nien--.

Signed and Sealed this

Sixth Day of November, 2007

JON W. DUDAS
*Director of the United States Patent and Trademark Office*